US007458330B2

(12) United States Patent
MacDonald et al.

(10) Patent No.: US 7,458,330 B2
(45) Date of Patent: Dec. 2, 2008

(54) TWO PIECE VIEW PORT AND LIGHT HOUSING WITH INTEGRATED BALLAST AND HIGH INTENSITY DISCHARGE LAMP

(75) Inventors: Ian MacDonald, Fort Lauderdale, FL (US); Randal Rash, Fort Lauderdale, FL (US)

(73) Assignee: Underwater Lights USA, LLC, Fort Lauderdale, FL (US)

( * ) Notice: Subject to any disclaimer, the term of this patent is extended or adjusted under 35 U.S.C. 154(b) by 0 days.

(21) Appl. No.: 11/717,356

(22) Filed: Mar. 13, 2007

(65) Prior Publication Data

US 2007/0209566 A1 Sep. 13, 2007

Related U.S. Application Data

(60) Provisional application No. 60/781,678, filed on Mar. 13, 2006.

(51) Int. Cl.
*B63B 19/00* (2006.01)
*F21V 29/00* (2006.01)

(52) U.S. Cl. ..... 114/177; 362/267

(58) Field of Classification Search ..... 114/177
See application file for complete search history.

(56) References Cited

U.S. PATENT DOCUMENTS

| | | | | |
|---|---|---|---|---|
| 3,513,585 | A | 5/1970 | Ross | |
| 4,219,871 | A * | 8/1980 | Larrimore | 362/264 |
| 4,290,094 | A | 9/1981 | Jensen | |
| 4,410,834 | A | 10/1983 | Witte et al. | |
| 4,420,799 | A | 12/1983 | Miller | |
| 4,574,337 | A | 3/1986 | Poppenheimer | |
| 4,617,615 | A | 10/1986 | Eychaner | |
| 4,683,523 | A | 7/1987 | Olsson et al. | |
| 4,931,915 | A | 6/1990 | Quiogue | |
| 4,947,304 | A | 8/1990 | Payne et al. | |
| 4,996,635 | A | 2/1991 | Olsson et al. | |
| 5,016,151 | A | 5/1991 | Mula | |
| 5,045,978 | A * | 9/1991 | Gargle | 362/101 |
| 5,089,945 | A | 2/1992 | Mula | |
| 5,105,346 | A | 4/1992 | Acks et al. | |
| 5,213,410 | A | 5/1993 | Acks | |
| 5,386,355 | A | 1/1995 | Acks | |
| 5,412,549 | A | 5/1995 | Blakely | |
| 6,053,623 | A | 4/2000 | Jones et al. | |
| 6,315,429 | B1 | 11/2001 | Grandolfo | |
| 6,443,592 | B1 | 9/2002 | Unger et al. | |
| 6,545,416 | B1 | 4/2003 | Fisher et al. | |
| 6,616,291 | B1 * | 9/2003 | Love | 362/101 |
| 6,679,619 | B2 | 1/2004 | Saieva | |
| 6,702,452 | B2 | 3/2004 | Jigamian et al. | |
| 6,877,874 | B2 | 4/2005 | Chauquet | |
| 7,044,623 | B2 | 5/2006 | Olsson et al. | |
| 7,305,929 | B2 * | 12/2007 | MacDonald et al. | 114/173 |
| 2006/0239013 | A1 * | 10/2006 | Olsson et al. | 362/362 |

* cited by examiner

*Primary Examiner*—Jesús D Sotelo
(74) *Attorney, Agent, or Firm*—Michael J. Keller; Lott & Friedland, P.A.

(57) ABSTRACT

The present invention is a view port suitable for installation under the water line of a vessel wherein the view port comprises a flange made from a corrosion resistant material and a body made from a heat resistant material. An alternative embodiment of the invention is an underwater light in which a high intensity discharge (HID) light and ballast is completely installed into the above-described view port.

31 Claims, 5 Drawing Sheets

TWO PIECE VIEW PORT AND LIGHT HOUSING WITH INTEGRATED BALLAST AND HIGH INTENSITY DISCHARGE LAMP

This application claims priority to corresponding U.S. Provisional Application No. 60/781,678, filed on Mar. 13, 2006, which is related to, cross-references and incorporates by reference the subject matter of U.S. Provisional Application No. 60/715,625, filed on Sep. 9, 2005, the disclosures and contents of which are expressly incorporated herein by reference.

BACKGROUND OF THE INVENTION

Underwater view ports have been used on ships, boats and other watercraft for decorative and safety purposes, as well as to aid exploration of the surrounding water. In order to see outside the watercraft from the interior, conventional view ports use a frame to mount a substantially transparent window to the hull. Smaller view ports have used a single piece, thru-hull having a mechanically or chemically fastened window inside the thru-hull fitting.

Similarly, lighting has been applied to these same types of watercraft to improve visibility during the dark hours or during periods of overcast or cloudy conditions. Lights have also been applied to illuminate the sides of the watercraft in order to better visualize the watercraft from a distance, to further enhance the appearance of the watercraft, and to illuminate the surrounding water area. Lights have been mounted in various locations on the deck or hull of the watercraft to accomplish this purpose.

Thru-hull mounted lights are often in the form of light strips that are composed of a string of high intensity light bulbs contained within a housing or a plurality of individual lights within a housing, that are applied externally along the perimeter of the hull and oriented to shine downwards along the hull in the direction of the water. Various applications of the housings and light shields are used to redirect the light rays from the light source downward along the surface of the hull, including the ability to adjust the housings in order to project the light beams along a desired path. Although such configurations provide substantial illumination of the hull sides, they are not waterproof or watertight and therefore are placed substantially higher than the waterline. Thus, little to no illumination of the surrounding water area is provided as the light intensity fades considerably from the light source as it reaches the waterline. Furthermore, because the light rays are directed downward along the surface of the hull, illumination is restricted primarily to the line of the watercraft and therefore does not deviate outward into the surrounding water and may be easily obstructed by other accessories that are attached to or protruding outwards along the sides of the watercraft which are closer to the waterline. Also, lights mounted on the exterior of the boat often require replacement and repair from outside the boat rather than from the inside of the boat which usually is fairly cumbersome.

In order to better project the light onto the surface of the water from a light source placed above the waterline, the lights have been extended outwards such that they are spaced farther away from the hull surface. For example, U.S. Pat. No. 5,355,149 discloses a utility light apparatus that is mounted on a gunwale of a boat by applying the light to the distal end of a conventional fishing rod holder such that the light extends out over the side of the boat in an arm-like fashion. Therefore, the extended light pathway illuminates more of the water's surface and is less likely to be obstructed by other appurtenances placed on the side of the boat. However, unless the height of the boat is relatively shallow, the depth to which the light penetrates the water is still very limited by the light intensity as the light source is placed well above the waterline at the gunwale of the boat. Thus, the conventional hull or deck mounted lights do not provide sufficient lighting for visualizing harmful objects within the path of the watercraft or exploring the water around and below the watercraft. Furthermore, lights extending outward from the surface of the boat are easily damaged in comparison to lights which are integrated into the surface area of the boat such that they are only slightly protruding or not protruding at all.

More recently, lights have been integrated into the surface area of a watercraft hull by placing the lights into the thru-hull fittings of the hull thereby providing a watertight lighting apparatus which may be positioned below the waterline in order to significantly improve visualization of the surrounding water area and to enhance the aesthetics of the boat. Also, by placing the light assembly inside a thru-hull, replacement or repair of the light assembly can be done from the inside of the boat where access is normally much simpler than outside the boat. Typically, a light bulb or lamp supporting means is placed inside the thru-hull from inside the boat and a secured lens is placed between the lamp and the exterior opening of the thru-hull such that the light passes through the lens and into the water. The light bulb supporting means is surrounded by a housing that is either cylindrical for a secure fit against the cylindrical sides of the thru-hull or is a conical, tapered piece which narrows towards the interior of the boat. A flange is placed flush against the exterior surface of the boat at the thru-hull and one or a series of O-rings or watertight sealants or adhesives are used to provide a watertight seal between the lens and the exterior opening of the thru-hull. The exterior flange is usually cast as one piece with a housing that penetrates the hull. This single casting then requires considerable machining to allow for placement of lenses and accessories that are used within the view port. Alternative constructs include manufacturing of the housing and flange as two separate pieces which are then welded together. The drawback of welded configurations is that if identical materials are not used for the separate pieces, welding the pieces together is difficult and the integrity of the weld may be suspect. When used in an underwater environment, failure of the weld could be catastrophic. Alternatively, the flange may be separate from the housing such that it is removably attached to the side of the hull by screws that are screwed into holes bored into the hull's surface or snapped into place by a snapping mechanism at the exterior opening of the thru-hull.

In addition, it is desirable to form the light housing and flange of two different types of metals in order to obtain the highest heat-dissipating light housing on the interior of the hull where the light source sits and the most anti-corrosive flange on the exterior of the hull where the assembly comes into contact with the water. A one-piece configuration of the housing and flange limits the entire assembly to one type of metal. Even where the flange and light housing are welded together, there are many metals which cannot be welded tightly to one another. Where the flange must be attached to the hull by screws, several screw-holes must be bored into the hull's surface thereby damaging the hull surface and providing additional inlets where water moisture may create damage. Where the flange is snapped into place, it is difficult to obtain a substantially watertight seal between the flange, lens and the exterior opening of the thru-hull.

Therefore, it is an object of this invention to provide a two-piece thru-hull light in which the flange and light housing are two separate pieces such that numerous combinations of metals may be used for their construction in order to provide a highly efficient assembly. Furthermore, the flange has a threaded surface which is screwed into the exterior surface of a cylindrical light housing thereby not damaging the hull surface and providing a substantially watertight seal.

It is also an object of this invention to secure the lighting apparatus to the hull in such a way that the hull is not damaged. The flange is comprised of a flanged mushroom-head shaped portion that is placed flush against the exterior surface of the hull opening. On the interior side of the hull opening, a compression ring surrounding the exterior surface of the light housing is compressed against the hull's interior surface by a threaded locking ring thereby securing the hull between the flange and compression ring. The locking ring compresses the compression ring against the hull by way of several screws whose ends abut the surface of the compression ring.

It is also an object of this invention that the cylindrical light housing may be adjustable so as to adapt to slight angle variations of the thru-hull sides with respect to the actual thru-hull opening on the exterior surface of the hull. Many thru-hull configurations use a ball and socket type of joint in order to allow the light housing angle to be adjusted. In the present invention, the screws which are threaded through the locking ring that serve to secure the compression ring against the interior surface of the hull may be threaded individually at different heights thereby tilting the compression ring at various angles in order to accommodate the thru-hull shape.

It is also an object of this invention that the assembly may be alternatively used to house a camera rather than a light. Many thru-hull light configurations use a concave lens to diverge the light rays for greater light dispersion through the water. However, such a lens would distort a camera view and therefore a flat lens is utilized in the present invention.

It is also an object of this invention that the assembly may alternatively house an integral ballast assembly such that a high intensity discharge (HID) lamp may be used as the light source without compromising the necessary ballast assembly to moisture outside the watertight assembly. The use of an HID lamp is preferable over incandescent or fluorescent lamps as HID lamps are more energy efficient, longer lasting, and provide a greater area of illumination despite its smaller size.

DETAILED DESCRIPTION OF THE INVENTION

The present invention is a two-piece thru-hull view port assembly constructed to have a watertight fit in the hull or deck of a vessel. The view port assembly may be used as, but not limited to, a viewing tool or window for the eye or for housing lights, still cameras or video cameras.

Figure 1:
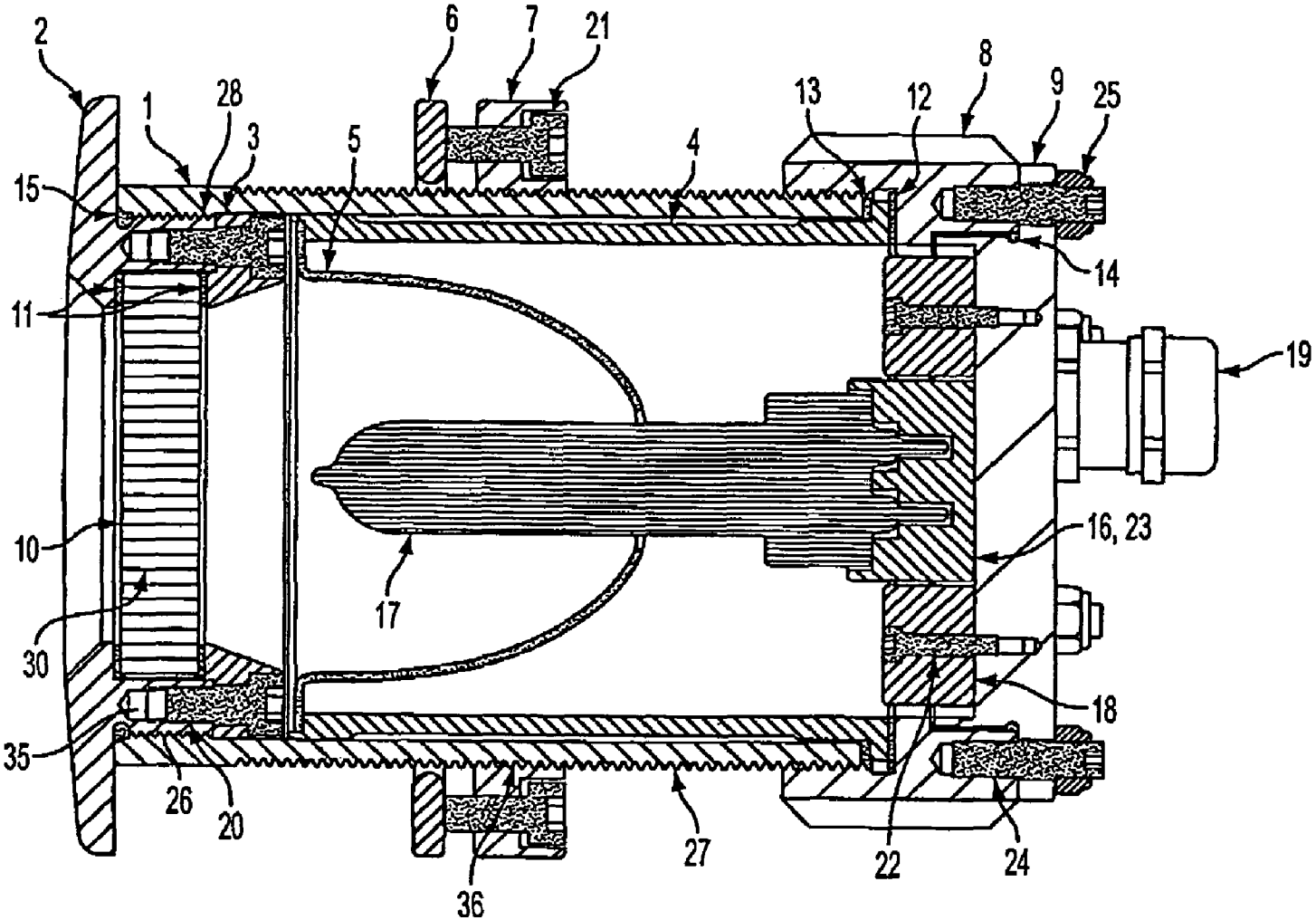
FIG. 1 is a cross-sectional view of the two-piece view port and light housing in a fully-assembled configuration.

Referring to FIG. 1, a flange 2 having an inner and outer face is used as the exterior mounting to the side of the vessel at the opening of the thru-hull. A substantially transparent lens 10 having a top and a bottom surface is removably mounted on the inner surface of the flange 2 and provides a window for viewing the outside of the vessel from within the interior of the vessel.

Lens 10 is in the shape of a disc and preferably has smooth, rounded edges and is composed of heat and pressure-resistant borosilicate. As will be appreciated by one of skill in the art, any substantially transparent material may be used that is resistant to high temperature, high pressure, erosion and damage from chemicals. Examples of suitable materials include chemically hardened or tempered, impact-resistant materials such as quartz glass, tempered glass (e.g. Pyrex®), borosilicate, or sapphire crystal. The lens is held in place by a lens retaining ring 3 and the flange 2 which is connected to the circumference of the lens retaining ring using cap screws 20. The interior surface of ring 3 is tapered such that the proximal end is of narrower diameter than the distal end. The hollow interior of the mushroom-head shaped portion of the flange is tapered inward such that the proximal end is of wider diameter than the distal end and the distal end is of narrower diameter than the threaded portion of the flange that is at the inside the main body 1 of the view port. The diameter of the distal end of the mushroom-head shaped portion of the front flange is equal to the diameter of the proximal end of the glass retaining ring thereby forming a retaining groove for capturing the lens between the mushroom-head shaped portion of the flange and the lens retaining ring. Gaskets 11 are placed on both sides of the lens in order to provide a watertight seal between the lens and the flange and between the lens and lens retaining ring. Gaskets 11 are preferably 1/16" of an inch thick and composed of compressed Aramid/Buna-N sheet gasket material. The inner surface of flange 2 contains a plurality of threaded screw holes 35 to which a lens retaining ring 3, having a circumferential body defining a lens opening 30, is affixed using cap screws 20 threaded into screw holes 35.

Figure 2B:
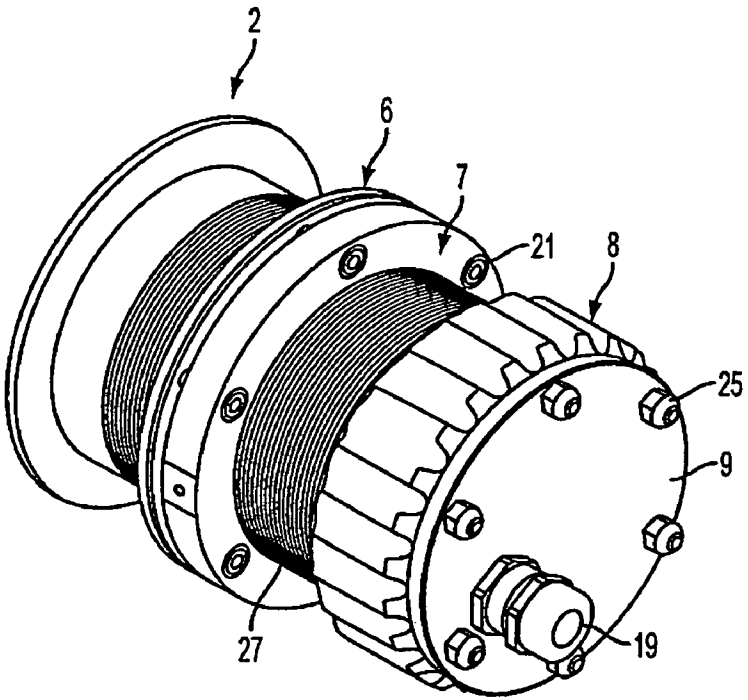
FIGS. 2*a* and 2*b* are oblique views of the two-piece view port having a watertight end cap.
Figure 2A:
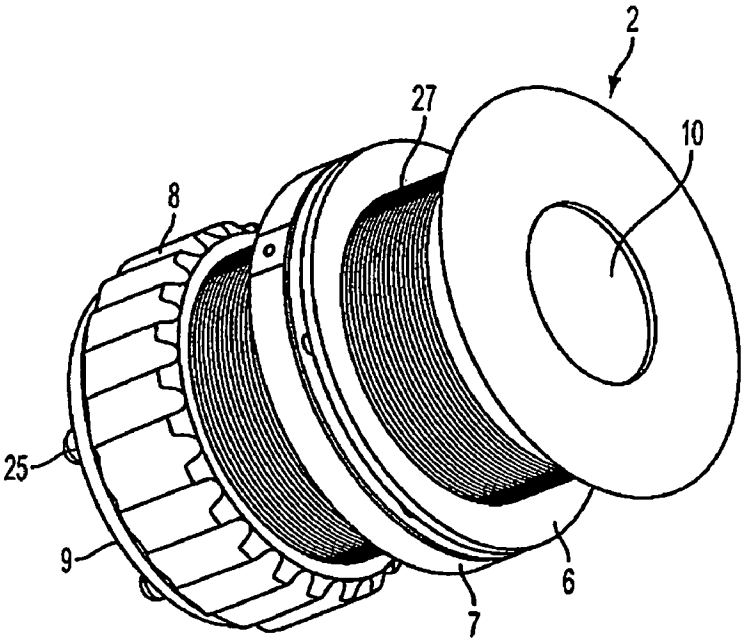

The main body 1 of the view port assembly is a hollow cylinder with a proximal end having internal threads 26 and a distal end having external threads 27 [also shown in FIGS. 2*a* and 2*b*]. The main body 1 is attached to the external threads 28 of the flange 2 by means of the internal threads 26. A polymer O-ring 15 or other suitable sealing means, such as silicone, polyether, polyurethane or other sealants acceptable for use below the waterline, are used for forming a watertight seal between the flange 2 and main body 1.

The view port assembly is secured to the inside of the vessel hull using a locking ring 7 [also shown in FIGS. 2*a* and 2*b*] having internal threads 36 which are sized to screw down on the external threads 27 of the main body 1. The locking ring is preferably composed of aluminum. By screwing down locking ring 7 onto the main body 1, flange 2 is pulled into position against the outside of the vessel hull. Optionally, in order to adapt the entire view port assembly to slight angular variations in the interior shape of the hull, a compression ring 6 [also shown in FIGS. 2*a* and 2*b*] in combination with locking ring 7 is provided along the exterior mid-portion of main body 1. Although the mushroom-head shaped portion of flange 2 must stay flush against the side of the vessel at the hull opening, the compression ring and locking ring may be adjusted such that the main body of the assembly may tilt slightly in order to accommodate angle variations in the hull. The compression ring is preferably composed of aluminum and has a smooth interior and exterior surface. The compression ring surrounds the exterior of the mid-portion of the main body and acts as a washer separating the main body from the interior walls of the hull. The corners of the compression ring are beveled so as to provide smooth contact with the walls of the hull. At the distal side of the compression ring, locking ring 7 is screwed onto the mid-portion of the main body 1 via its threaded interior surface. Along the circumference of the locking ring are one or more cap screws 21 whose bodies extend past the locking ring and abut the distal side of the compression ring. Thus, in order to vary the angle at which the compression ring aligns the assembly with the walls of the hull, each of screws 21 may be individually threaded into the bores of the locking ring to different heights so as to change the angle of the abutting compression ring.

The advantage of using a two-piece thru-hull to define a view port, instead of a singular piece, is that the separate pieces can be individually manufactured from the most suitable materials for the environment and/or the application in which that individual piece will be used. Therefore, the entire assembly is not restricted to one material that may only minimally satisfy the various environments and/or applications in which it may be used. In the present invention, the thru-hull piece must be constructed of materials that satisfy two very different environments simultaneously. The most suitable materials for use in the areas exposed to the water are metals which have sufficient structural strength and resistance to corrosion from the exposure in order to maintain a watertight seal below the waterline. The most suitable materials for use in the areas which are placed in the interior of the vessel are materials which have sufficient mechanical strength for securing or fastening the flange and highly efficient heat transferring properties in order to minimize the build up of heat within the view port. Table 1 is a list of the galvanic potential of various common metals, starting with magnesium which is the most reactive and ending with platinum which is the least reactive.

TABLE 1

Galvanic Properties

| Most Reactive | Least Reactive |
|---|---|
| MAGNESIUM | COPPER (CA102) |
| MAGNESIUM ALLOYS | MANGANESE BRONZE (CA 675), TIN BRONZE (CA903, 905) |
| ZINC | SILICON BRONZE |
| ALUMINUM 5052, 3004, 3003, 1100, 6053 | NICKEL SILVER |
| CADMIUM | COPPER - NICKEL ALLOY 90-10 |
| ALUMINUM 2117, 2017, 2024 | COPPER - NICKEL ALLOY 80-20 |
| MILD STEEL (1018), WROUGHT IRON | 430 STAINLESS STEEL |
| CAST IRON, LOW ALLOY HIGH STRENGTH STEEL | NICKEL, ALUMINUM, BRONZE (CA 630, 632) |
| CHROME IRON (ACTIVE) | MONEL 400, K500 |
| STAINLESS STEEL, 430 SERIES (ACTIVE) | SILVER SOLDER |
| 302, 303, 304, 321, 347, 410, 416, STAINLESS STEEL (ACTIVE) | NICKEL (PASSIVE) |
| NI - RESIST | 60 NI-15 CR (PASSIVE) |
| 316, 317, STAINLESS STEEL (ACTIVE) | INCONEL 600 (PASSIVE) |
| CARPENTER 20 CB-3 STAINLESS (ACTIVE) | 80 NI-20 CR (PASSIVE) |
| ALUMINUM BRONZE (CA 687) | CHROME IRON (PASSIVE) |
| HASTELLOY C (ACTIVE) INCONEL 625 (ACTIVE) TITANIUM (ACTIVE) | 302, 303, 304, 321, 347, STAINLESS STEEL (PASSIVE) |
| LEAD - TIN SOLDERS | 316, 317, STAINLESS STEEL (PASSIVE) |
| LEAD | CARPENTER 20 CB-3 STAINLESS (PASSIVE), INCOLOY 825 |
| TIN | NICKEL - MOLYBDEUM - CHROMIUM - IRON ALLOY (PASSIVE) |
| INCONEL 600 (ACTIVE) | SILVER |
| NICKEL (ACTIVE) | TITANIUM (PASSIVE) |
| | HASTELLOY C & C276 (PASSIVE), INCONEL 625 (PASSIVE) |
| 60 NI-15 CR (ACTIVE) | GRAPHITE |
| 80 NI-20 CR (ACTIVE) | ZIRCONIUM |
| HASTELLOY B (ACTIVE) | GOLD |
| BRASSES | PLATINUM |

For the areas of the view port assembly that are exposed to the water and environment outside of the vessel, it is preferred to use materials from the least reactive materials in Table 1 that have the appropriate mechanical properties for the application. Standard marine fittings are generally made of bronze, the 316 or 317 stainless steel for both their strength and corrosion resistance when used below the waterline. However, these materials do not dissipate heat well. As such, they are less preferred for use in applications where external heat may be generated, such as in a light or camera housing. When the view port assembly will hold a heat-emitting device, it is preferred that the body of the assembly be made from materials capable of rapidly dispersing the heat, such as aluminum or copper. However, most grades of aluminum create a galvanic cell and corrode rapidly when immersed in an aqueous environment in the presence of any other metals. Also, saltwater is an excellent electrolyte and fosters the creation of galvanic currents. Therefore, in the marine environment, other metals are usually always present in the form of standard bronze for thru-hull plumbing fittings, propellers, rudder hardware, etc. Aluminum is a poor choice for any external use on any vessel hull and in no instance should aluminum be directly welded or affixed to steel hull vessels. While plastics do not corrode and have been used in thru-hull devices, they lack sufficient strength and durability for use in applications that are below the waterline. They are also cosmetically unappealing in comparison to highly-polished metals.

The present invention allows for the use of corrosion resistant materials on the wet outside of the vessel hull and the use of heat dissipating materials on the dry inside of the vessel hull. For example, the flange can be made of a corrosion resistant metal such as bronze, stainless steel, or titanium. The body is preferably made of a strong heat dissipating metal such as aluminum, titanium or brass or alloys thereof.

In one embodiment of the view port, the flange 2 can be directly welded to the vessel hull. When welded, there is no need to bed the flange to the hull to reduce leaks and the internal locking and compression rings are eliminated.

Referring back to FIG. 1, when the view port is used to house a light or camera, a reflector housing 4 is slip fit or optionally threaded into the inside of the main body 1. A resilient, polymer O-ring 13, preferably composed of nitrile rubber, lies between the distal ends of the reflector housing 4 and the main body 1 so as to ensure a watertight seal between the reflector housing and adjacent components. While the primary water resistance is provided by the flange 2 and O-ring 15, secondary water resistance can be provided by use of a threaded end cap which is screwed onto the distal end of the main body. This cap may be a single piece or preferably two pieces comprising a threaded connecting ring 8 and a lid 9 [as shown in detail in FIGS. 2*a* and 2*b*]. The cap may be made out of any suitable metal or polymer material, although marine grades of aluminum are most preferred due to their corrosion resistance and strength when used inside the vessel and their ability to rapidly dissipate heat compared to other materials having suitable mechanical properties. O-rings or gaskets 12 of the connector ring 8 and O-rings or gaskets 14 of the lid 9 are used to maintain a watertight seal between the connecting ring and the main body and between the lid and the connecting ring. Any heat and water resistant gasket material, such as Aramid/Buna-N sheet gasket material, can be used for the gaskets. When used, it is most preferred that the lid 9 is secured to the distal end of the connector ring 8 via a plurality of screws 24 in combination with locknuts 25 placed around the lid's circumference. The external surface of the cap or connector ring may be shaped for use with tools or contain ridges or other means to improve a hand grip when screwing or unscrewing the connector ring or cap from the main body. The connector ring and the cap can also assume any design which does not interfere with its mechanical function. Such designs include aesthetically pleasing designs and designs to improve the heat dissipation of the cap or connector ring. Heat dissipation may be improved by the inclusion of a plurality of cooling fins, ridges or other means to increase the surface area for heat dissipation or to facilitate additional air flow around or through portions of the cap, connector ring and lid.

When used with a wired device, such as a light or camera, the lid contains a cable strain relief structure 19 for coupling the light or camera to a cable that originates from inside the vessel and provides power or a data signal to and/or from the light, camera or other device that is mounted inside the view port assembly. Signals that may be transmitted include still or video images or signals acquired from infrared or other sensors capable of receiving data through a view port.

Porcelain terminal blocks 18 serve to electrically and mechanically connect the lamp socket 16, camera or sensor structure to the lid using cap screws 22. The lamp socket 16 may be elongated as necessary to place the lamp in the optimal location within the reflector housing for light and heat dissipation, or alternatively the socket can be variably positioned using spacers between the socket and the lid. Also, non-conducting standoff bodies [not shown] may be placed between the terminal blocks 18 and the projector lid 9 so as to change the placement of the terminal blocks with respect to the projector lid when needed. The lamp socket contains a lamp 17 which may be one of several types of lamps including halide, halogen or xenon gas.

For lamp or camera replacement, the connector ring 8 is accessed from the interior-side of the vessel at the inside of the hull and is unscrewed such that the connector ring and lid assembly, which is connected to the lamp or camera, may be removed in the distal direction. The remaining components of the lighting assembly remain in the thru-hull thereby leaving a sealed viewing hole in place during repair.

The reflector housing 4 houses lamp 17 and supports a reflector 5 at its proximal end. The reflector tube is preferably composed of a heat dissipating material such as aluminum and is shaped such that the distal end of the reflector tube 4 is affixed between the distal end of the main body 1 and the connector ring 8, and the proximal end of the reflector 5 is secured between the proximal end of the reflector tube and the lens retaining ring 3. While any suitable mechanical means is acceptable, the use of a lip on the proximal and distal ends of the reflector housing is most preferred.

In order to intensify the light rays originating from lamp 17, reflector 5 has a parabolic-curved or other concave surface which protrudes rearward into the hollow interior of the view port assembly towards the distal end. Lamp 17 extends through the circular aperture at the center of the reflector's surface such that the reflector serves to provide maximum light projection and brightness from lamp 17.

Figure 3A:
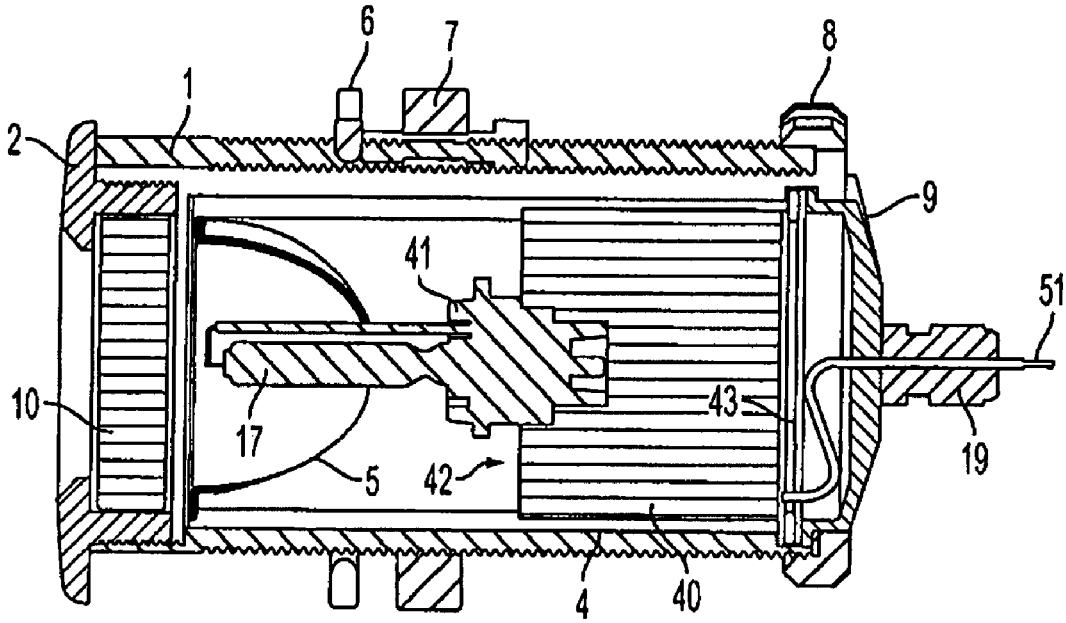
FIGS. 3*a* and 3*b* are cross-sectional, front and back views respectively of the two-piece view port and light housing with a high intensity discharge lamp and integral ballast in a fully-assembled configuration.
Figure 3B:
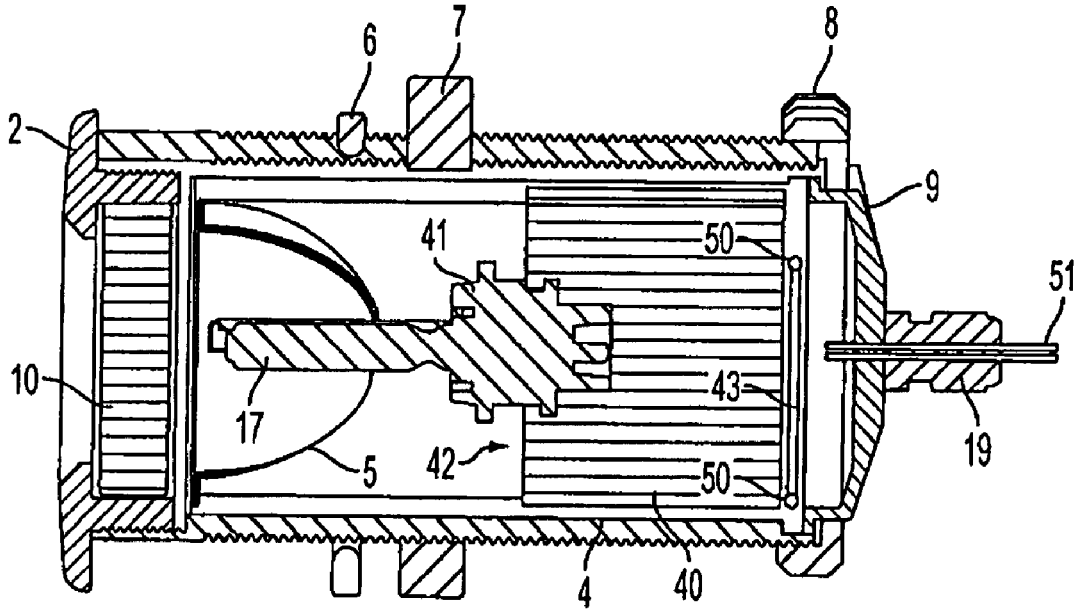
Figure 3C:
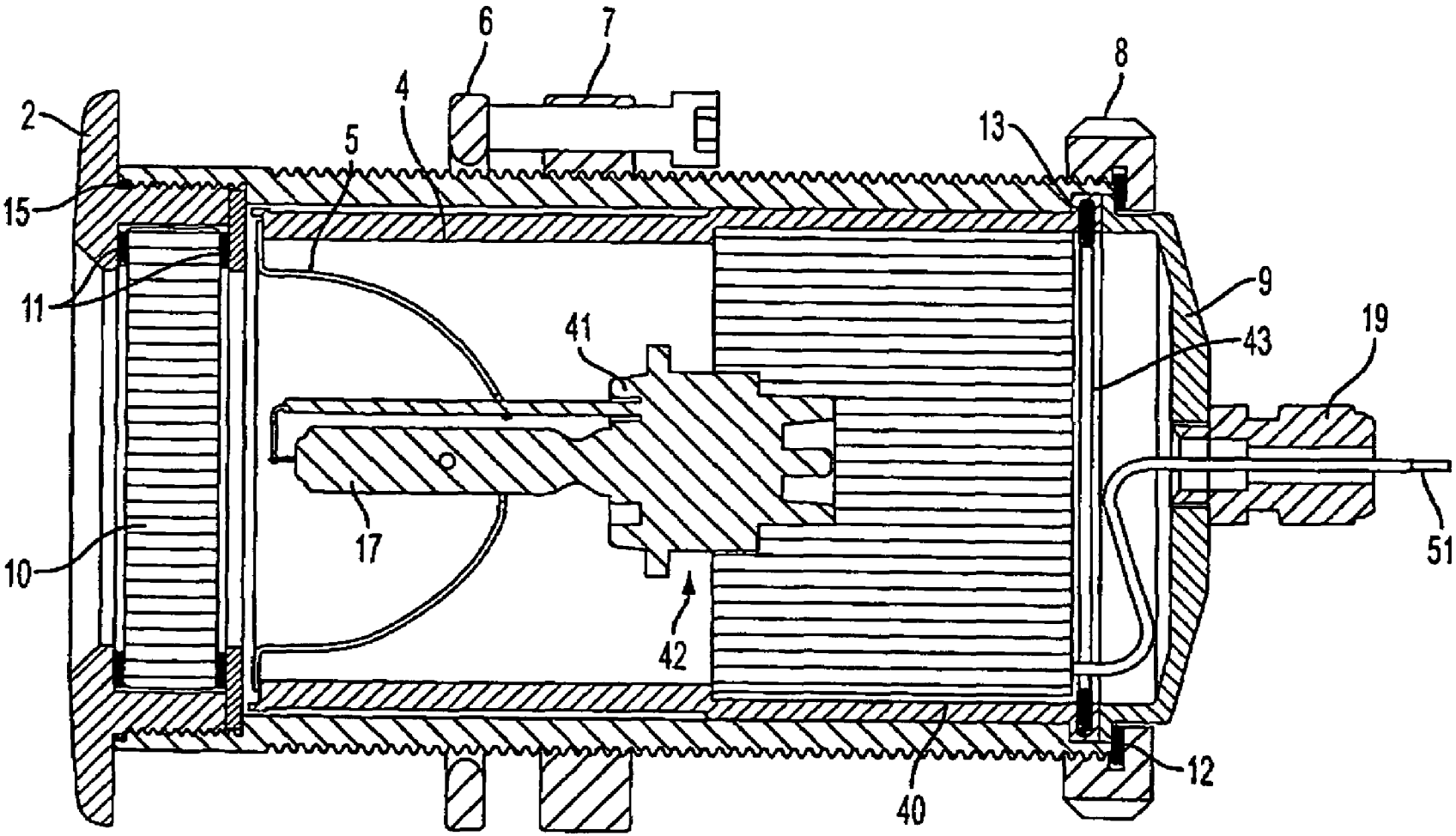
FIG. 3*c* is a cross-sectional view of the two-piece view port and light housing with a high intensity discharge lamp and integral ballast in a fully-assembled configuration.

Referring to FIGS. 3*a*-3*c*, in another embodiment of the present invention, the view port assembly may be safely and effectively used to house a high intensity discharge lamp. Until recently, many high intensity light sources required relatively large external ballasts to produce the high voltages necessary to power the light. The compact size limitations made it difficult to incorporate the necessary ballast within a lighting fixture. Even more important, ballasts generate considerable heat as they step-line voltage to the output voltage required to drive the light and as a result, required significant ventilation to prevent the overheating of a housed ballast. Such ventilation is typically provided by using large heat sinks, ventilation slots on the housing and/or by use of a thermostatically controlled electrical fan. Until now, it has been impossible to fully enclose a ballast and a high intensity metal halide light source inside of a single watertight thru-hull enclosure.

Recent advances in metal halide technology have resulted in combined bulb and ballast units that eliminate the need for an external ballast. While larger than the light bulb alone, these new bulbs with integrated ballasts are sufficiently small and lightweight allowing their use in relatively small enclosures. The build up of heat still remains a problem as the lamp and ballast are cooled by use of a heat sink which must be able to dissipate the heat to its environment. A suitable ballast for such use is the SYS03510 sold by Auersman Electronics. The current ballast technology limits the ballast to a maximum temperature of 80° C. Most known light housings will quickly exceed this temperature during use.

The present invention solves the heat dissipation problem by allowing the reflector housing and light housing to serve as a further heat sink than that already provided in the integrated bulb. Using the two-piece thru-hull assembly described above, the reflector housing is sized such that it maintains physical and thermal contact with the light bulb and ballast.

The ballast and reflector housing are made to close tolerances to minimize any air gap which would reduce the efficiency of heat transfer. Similarly, the reflector housing and light housing are in close tolerances to minimize any air gap between the parts. It is desired that there be a minimal gap between any heat dissipating components and most preferably that the components are in direct physical contact. The reflector housing and light housing are both made of a heat conducting material which conducts the heat from the existing heat sink of the integrated bulb through the reflector housing and through the light housing to the open interior of the vessel.

Where lamp 17 is a high intensity discharge lamp, an electric ballast 40 must be used in order to provide the proper electrical starting and operating current and voltages to the lamp. Typically, a lamp support structure is physically separated from the ballast structure such that the ballast structure is found outside the lamp housing. In the present invention, placing the ballast structure outside the watertight thru-hull housing will subject the ballast and the connecting wires between lamp 17 and the ballast structure to the dangerous effects of moisture or require the ballast to be placed some distance from the lamp structure, reducing the ability of the ballast to adequately operate the lamp. As shown in FIGS. 3*a*-3*c*, a remedy is provided by bringing ballast 40 inside the thru-hull housing so as to extend the watertight protections of the thru-hull piece to the ballast structure and lamp connections as well. FIG. 3*c* depicts ballast 40 as replacing the lamp-retaining mechanism of lamp socket 16 and porcelain terminal block(s) 18 as are shown in FIG. 1. Accordingly, the ballast is now directly connected to the lamp 17 and is directly wired to the switch and power supply (not shown) through wires 51 [as shown in FIGS. 3*a* and 3*b*]. Ballast 40 has a cylindrical body, preferably constructed of aluminum, such that its diameter fits snuggly within the diameter of the reflector housing 4 at the distal end of the main body. As mentioned above, ballast 40 has an integrated lamp socket 41 such that lamp 17 may be directly plugged into the ballast structure. However, in no way is this description meant to limit the present embodiment to a ballast with an integrated lamp socket.

Figure 4:
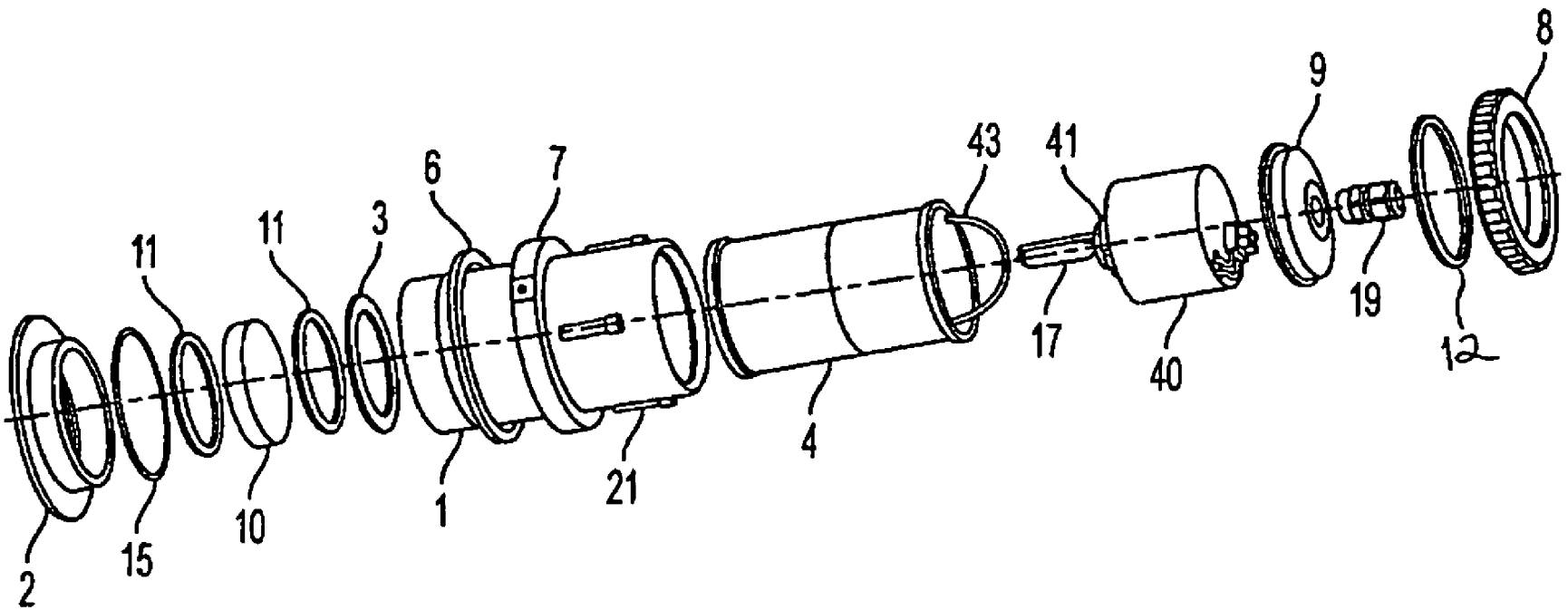
FIG. 4 is an exploded view of the two-piece view port and light housing with a high intensity discharge lamp and integral ballast.

With the removal of lamp socket 16 and porcelain terminal block(s) 18 as described above, cap screws 22 are no longer needed to secure the lamp assembly to lid 9. As was described in FIG. 1, the distal end of the main body may be enclosed by a threaded cap which may be screwed onto the main body. This cap may be a single piece or preferably two pieces comprising a threaded connecting ring 8 and a lid 9 whereby lid 9 abuts the distal end of reflector housing 4 and is secured in place by connecting ring 8 [as shown in FIGS. 3*a*-3*c*]. The light and ballast assembly 42 are retained in the reflector housing 4 by means of a wire pull-handle 43. The pull-handle 43 fits into holes 50 [as shown in FIG. 3*b*] on either side of the reflector housing and allows for easy removal of the assembly 42 for changing bulbs or performing other maintenance on the light. FIG. 4 illustrates pull-handle 43 in the extended position used to remove the assembly 42.

In order to test the thermal conditions of the integrated light and ballast assembly within a small enclosure, a 12 V, 50 Watt metal halide light having an integrated ballast was installed in a light housing, having a reflector and body made from aluminum, and a bronze head. The light assembly was installed in a test water tank and run to simulate average nighttime usage. The initial temperature of the test water tank was 21° C. and the room temperature was 20° C. The initial relative humidity was 40%. The temperature of the reflector housing, ballast and main body of the light housing were sampled. The results of the test are shown below in Table 2.

TABLE 2

Test Results of Thermal Conditions of An Enclosed Integrated Light and Ballast Assembly

| Time | Reflector T (° C.) | Ballast T (° C.) | Body T (° C.) |
|---|---|---|---|
| 11:46 a.m. | 28 | 27 | 24 |
| 1:35 p.m. | 52 | 60 | 45 |
| 2:10 p.m. | 57 | 72 | 51 |
| 3:10 p.m. | 58 | 72 | 53 |
| 4:15 p.m. | 60 | 72 | 54 |
| 5:05 p.m. | 62 | 72 | 56 |

The same test shown in Table 2 was conducted with similar lights without an integrated ballast to show the effects of different types of housing materials on heat accumulation. Table 3 below was conducted under substantially the same conditions as the test in Table 2. The same type of high intensity discharge light was used.

TABLE 3

Test Results of Thermal Conditions of An Enclosed High Intensity Discharge Light Using Different Metals

| | Aluminum | | Bronze | | Stainless Steel | |
|---|---|---|---|---|---|---|
| Time | Body (° C.) | Cap (° C.) | Body (° C.) | Cap (° C.) | Body (° C.) | Cap (° C.) |
| 12:15 p.m. | 24 | 23 | 24 | 23 | 24 | 23 |
| 1:10 p.m. | 49 | 50 | 39 | 67 | 59 | 100 |
| 2:15 p.m. | 52 | 53 | 41 | 73 | 64 | 110 |
| 3:05 p.m. | 53 | 53 | 40 | 74 | 65 | 110 |
| 4:30 p.m. | 49 | 47 | 40 | 62 | 60 | 96 |

The results shown in Table 3 indicate that stainless steel is unacceptable as a housing material for a device having an integrated light and ballast as it would allow the ballast to reach in excess of 80° C., the maximum heat rating for the ballast, at the cap. Similarly, bronze is only marginally acceptable because it reaches temperatures close to the maximum heat rating for the ballast and might, in warmer water or temperatures, lead to overheating of the ballast.

As is apparent to one of skill in the art, departures may be made from such details of the present invention without departing from the spirit and scope of the present invention. The use of alternative materials, for example with respect to the metals, sealants, polymers and transparent glasses and polymers is both contemplated and expected as improvements are made in the relevant art.

We claim:

1. A thru-hull light comprising:

a flanged housing having a main body and a water tight lens for attaching to the exterior of a vessel a reflector housing located within the flanged housing, an electric ballast sized to fit inside the main body having a lamp socket affixed or integral thereto;

a lamp mounted in the lamp socket;

a cap removably attached to the distal end of the main body having a means for conducting power to the electric ballast; and a means for securing the housing to a vessel.

2. The thru-hull light of claim 1 further comprising a means of retrieving the electric ballast from inside the main body.

3. The thru-hull light of claim 2 further wherein the means of retrieving the electric ballast from inside the main body is a pull handle.

4. The thru-hull light of claim 1 wherein the means for securing the housing to a vessel is selected from bonding, welding or mechanical fastening.

5. The thru-hull light of claim 4 wherein the mechanical means for securing the housing to a vessel is a locking ring.

6. The thru-hull light of claim 5 wherein the locking ring is used with a compression ring.

7. The thru-hull light of claim 1 wherein the water tight lens is secured to the flanged housing by bonding or mechanical fastening.

8. The thru-hull light of claim 7 wherein the mechanical fastening for securing the lens to the flanged housing is a tens retaining ring.

9. The thru-hull light of claim 1 wherein a watertight seal is provided at the watertight lens using sealants, O-rings, gaskets or mechanical seals.

10. The thru-hull light of claim 1 wherein the lamp is selected from halogen, xenon gas or metal halide lamps.

11. The thru-hull light of claim 1 further comprising a camera.

12. The thru-hull light of claim 1 wherein the flanged housing is comprised of a flange and the main body wherein the flange and main body are comprised of two different metals.

13. The thru-hull light of claim 12 wherein the flange is comprised of a highly corrosion resistant material.

14. The thru-hull light of claim 13 wherein the flange is selected from stainless steel, bronze or titanium.

15. The thru-hull light of claim 12 wherein the housing is comprised of a heat dissipating metal.

16. The thru-hull light of claim 15 wherein the housing is selected from aluminum, titanium or brass.

17. A thru-hull light comprising:

an annular external flange that is comprised of a mushroom-head shaped portion to be placed flush against an exterior opening of a vessel and a narrower cylindrical portion with a threaded exterior surface;

a cylindrical, hollow main body, placed in the interior of the exterior opening, that is comprised of a light housing and has an exterior threaded surface and an interior threaded surface for mating to the threaded portion of the external flange;

a lens sized to fit the annular opening of the external flange;

a means for securing the lens to the external flange;

a means for providing a watertight seal on both sides of said lens;

a reflector housing sized to fit inside the main body comprising a reflector;

an electric ballast sized to fit inside the main body having a lamp socket affixed or integral thereto;

a lamp mounted in the lamp socket;

a cap removably attached to the distal end of the main body having a means for conducting power to the electric ballast; and a means for securing the light housing to a vessel.

18. The thru-hull light of claim 17 wherein a means of retrieving the electric ballast from inside the main body is a pull handle affixed to the reflector housing.

19. The thru-hull light of claim 17 wherein the means for securing the light housing to a vessel is selected from bonding, welding or mechanical fastening.

20. The thru-hull light of claim 19 wherein the mechanical fastening means is a locking ring.

21. The thru-hull light of claim 20 wherein the locking ring is used with a compression ring.

22. The thru-hull light of claim 17 wherein the means for securing the lens to the external flange is selected from bonding or mechanical fastening.

23. The thru-hull light of claim 22 wherein the mechanical means for securing the lens to the external flange is a lens retaining ring.

24. The thru-hull light of claim 17 wherein the means for providing a watertight seal is selected from sealants, O-rings, gaskets or mechanical seals.

25. The thru-hull light of claim 17 wherein the lamp is selected from halogen, xenon gas or metal halide lamps.

26. The thru-hull light of claim 17 further comprising a camera.

27. The thru-hull light of claim 17 wherein the flange and the light housing are comprised of two different metals.

28. The thru-hull light of claim 27 wherein the flange is comprised of a highly corrosion resistant material.

29. The thru-hull light of claim 28 wherein the flange is selected from stainless steel, bronze or titanium.

30. The thru-hull light of claim 27 wherein the light housing is comprised of a heat dissipating metal.

31. The thru-hull light of claim 30 wherein the light housing is selected from aluminum, titanium or brass.

* * * * *